United States Patent [19]

Tana et al.

[11] Patent Number: 4,973,094

[45] Date of Patent: Nov. 27, 1990

[54] CRANE IMPLEMENT FOR HOISTING AND LAUNCHING BOATS TO AND FROM A QUAY

[75] Inventors: Guido Tana, Luino; Patrizio Alberichi, Trezzano sul Naviglio, both of Italy

[73] Assignee: Marinestar Nautica Di Tana Guido & C. S.N.C., Italy

[21] Appl. No.: 409,173

[22] Filed: Sep. 19, 1989

[30] Foreign Application Priority Data

Sep. 27, 1988 [IT] Italy ..... 83665 A/88

[51] Int. Cl.[5] ..... B66C 1/42

[52] U.S. Cl. ..... 294/81.21; 114/44; 294/81.3; 294/81.54; 405/3

[58] Field of Search ..... 294/67.1, 67.3, 67.33, 294/67.5, 81.2–81.4, 81.5–81.54, 81.62, 86.41, 904; 114/44, 45, 48, 51, 365, 366; 405/3; 414/678

[56] References Cited

U.S. PATENT DOCUMENTS

| | | | |
|---|---|---|---|
| 3,045,839 | 7/1962 | Hibberd | 114/44 X |
| 3,409,153 | 11/1968 | Stearn et al. | 405/3 X |
| 3,596,968 | 8/1971 | Holm | 294/81.3 |
| 3,945,673 | 3/1976 | Visser | 294/81.54 X |
| 4,245,941 | 1/1981 | Charonnat | 294/81.3 |
| 4,266,904 | 5/1981 | Fadness | 294/81.4 X |
| 4,553,719 | 11/1985 | Ott | 294/81.54 X |
| 4,686,920 | 8/1987 | Thomas | 114/51 X |

FOREIGN PATENT DOCUMENTS

| | | | |
|---|---|---|---|
| 1506504 | 7/1969 | Fed. Rep. of Germany | 294/904 |
| 2280578 | 2/1976 | France | 294/81.54 |
| 328627 | 8/1936 | Italy | 294/904 |
| 491577 | 11/1975 | U.S.S.R. | 294/81.54 |

*Primary Examiner*—Johnny D. Cherry

*Attorney, Agent, or Firm*—Browdy and Neimark

[57] ABSTRACT

Hoisting of boats is made faster and performable by a single operator by utilizing an hoisting apparatus which can be used with any lifting crane available and which comprises a balance having at least a longitudinal beam and two tubular crossbeams, out of the extremities of which extend, respectively, horizontal arms telescopically extensible and retractable driven by remotely controlled hydraulic cylinders. A vertical leg is rigidly fixed at the free extremity of each horizontally extensible arm and the leg is provided with a cantilevered foot carrying a support plate keel of the boat to be hoisted. The hanging of the balance on the crane's hook is implemented by means of a suspension carriage running along the central longitudinal beam of the balance, the longitudinal position of which may be remotely controlled by the operator by means of a hydraulic cylinder. A mechanism for rotating the suspended load in respect to the crane is also disclosed.

7 Claims, 2 Drawing Sheets

FIG. 1
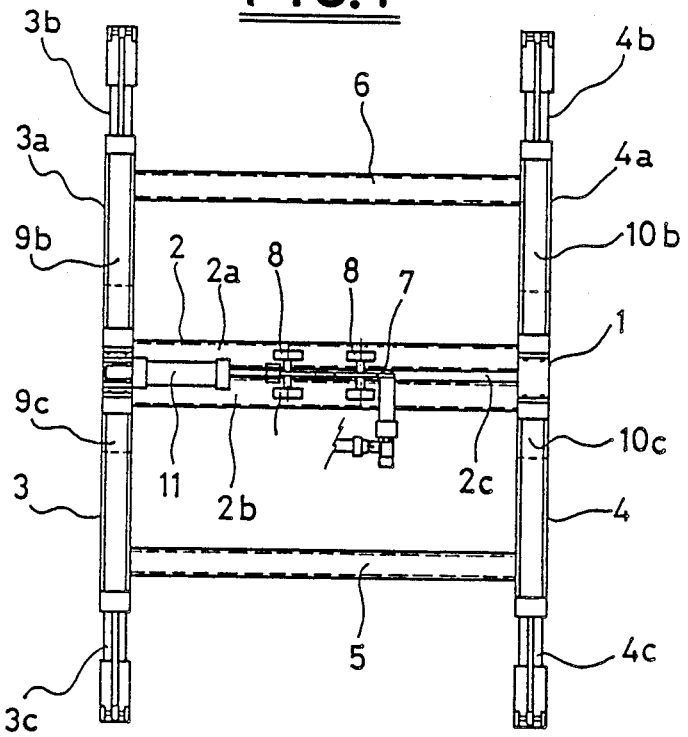
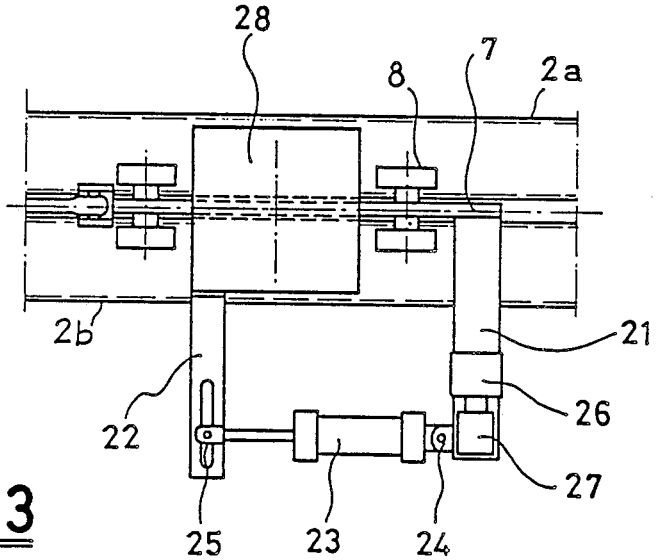
FIG. 3

CRANE IMPLEMENT FOR HOISTING AND LAUNCHING BOATS TO AND FROM A QUAY

BACKGROUND OF THE INVENTION

1. Field of the invention

The present invention relates to an apparatus for hoisting boats which may be used with any available lifting means and which is particularly suited for a mobile crane or for a quay crane.

2. Description of the prior art

Commonly, cranes used for hoisting small and mediumsized boats, typically pleasure boats such as speed boats and sail boats, to and from a quay, utilize a slinging structure formed by a balance frame of suitable dimensions constituted by a sturdy frame of rolled steel sections and having commonly an "H" shape, on the longitudinal beam member of which there is a ring for receiving the hook of the lifting crane. Slings, commonly of textile fibers, are passed under the bottom of the boat and hooked to the ends of the two crossbeams of the balance. A correct positioning of the two slings is crucial in order to ensure a safe trim of the boat when it is lifted out of the water or of the cradle and slings positioning is an operation made manually and often repeated for adjusting the trim after testing it by lifting the boat that much as to be able to judge whether the slings position is correct, before the boat can be lifted safely out of the water or out of the docking cradle. These manual operations require at least two persons and a relatively long time, thus limiting productivity on the quay.

OBJECTIVE AND SUMMARY OF THE INVENTION

The main objective of the present invention is to provide an improved hoisting and launching apparatus capable of permitting a single operator to hoist and launch boats under safe conditions and in a relatively short time and which may be used with any lifting means available on site.

Basically, the hoisting apparatus of the present invention comprises a balance frame provided with extensible and retractable arms which may be controlled by the operator of the lifting crane and hanging means crane-mounted on a carriage running along a central longitudinal beam member of the balance frame, the positioning of which therealong may also be controlled by the same operator of the lifting crane in order to bring the lifting point to coincide (at least in a longitudinal direction) with the vertical axis passing through the center of gravity of the suspended load. To the extremity of each extensible tranverse horizontal arm is fixedly connected a vertical leg of adjustable length which terminates with a cantilevered foot provided with a plate for supporting the keel of the boat to be lifted. The two pairs of transverse arms may be commanded by the operator to "close" against the opposite shipboards of the boat in order to bring the support plates under the boat's keel and the boat may then be lifted as much as sufficient to verify the longitudinal trim which may then be easily adjusted by the operator himself by commanding the displacement in one or the other longitudinal direction of the suspension carriage along the central longitudinal beam of the balance frame.

In this way a single operator is capable of hoisting a boat in a relatively short time while safely acting from a crane's shack or from the lifting crane's control pannel location.

BRIEF DESCRIPTION OF THE DRAWINGS

The different aspects and advantages of the invention will be clearly evidenced by means of the following detailed description of an embodiment of the invention depicted in the annexed drawings, wherein:

FIG. 1 is a schematic plan view of the balance of the hoisting apparatus of the invention;

FIG. 3 is an enlarged partial plan view of the balance of the apparatus of the invention provided with means for rotating the balance remotely controlled by the operator.

DESCRIPTION OF THE PREFERRED EMBODIMENT

Figures 2, 2A:
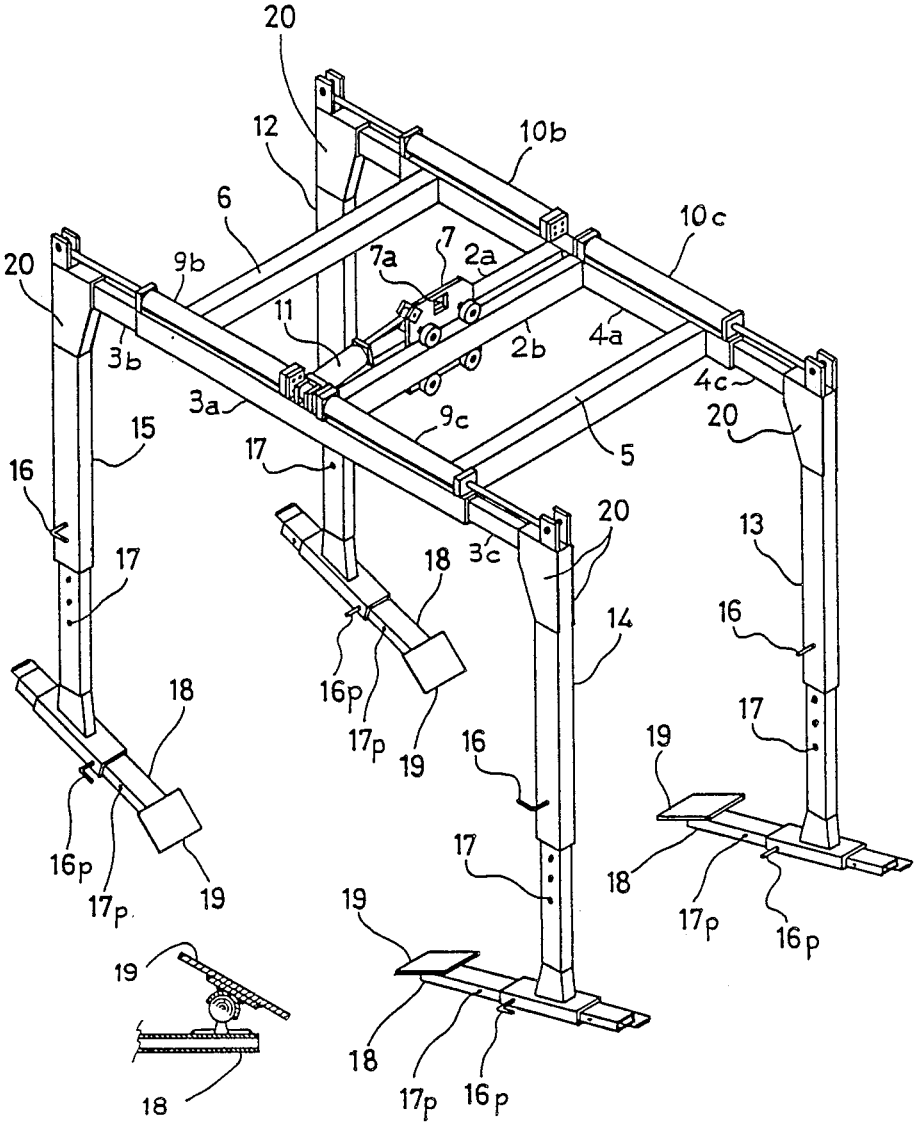
FIG. 2 is a schematic perspective view of the apparatus of FIG. 1.
FIG. 2*a* shows a detailed view of foot 18.

As shown in the figures, according to a preferred embodiment of the invention, the apparatus for hoisting boats comprises a balance frame 1 having a central longitudinal beam 2, two crossbeams, respectively 3 and 4, and preferably two side strengthening longitudinal beams, respectively 5 and 6. The central longitudinal beam 2 is preferably formed, as shown in FIG. 1, by a pair of parallel longitudinal sections, respectively indicated with 2*a* and 2*b* in the figures, which are spaced one from the other in order to leave a space 2*c* through which a vertical plate 7 may run freely. The vertical plate 7 constitutes the body of a suspension carriage running on four pairs of opposed wheels 8 running, respectively, on the upper and lower surface of both the parallel longitudinal sections 2*a* and 2*b* which together form an essentially central, longitudinal beam of the balance. The longitudinal beam may be alternatively formed by a single steel section member, in which case the hanging carriage may be differently configured, e.g. as a fork, as it will be evident to a skilled technician.

The carriage running along the central longitudinal beam of the balance structure, whichever configuration it has, is provided with means for hanging on the hook of a lifting crane or of a similar lifting machine. In the embodiment shown (FIG. 2), said hanging means is constituted by a hole 7*a* made in the top portion of the vertical plate 7.

Each of the two parallel crossbeams 3 and 4 comprises an essentially tubular central member, respectively indicated with 3*a* and 4*a* in FIG. 1, and two horizontal, telescopically extensible arms, indicated respectively with 3*b* and 3*c* and with 4*b* and 4*c*.

In the embodiment shown in FIG. 1, each extensible horizontal arm is driven by an hydraulic cylinder, indicated respectively with 9*b* and 9*c* for the pair of arms 3*b* and 3*c* and with 10*b* and 10*c* for the other pair of horizontal arms 4*b* and 4*c*. According to a preferred embodiment, each pair of extensible arms (3*b*–3*c* and 4*b*–4*c*) is acted upon by means of a single mechanism an to this end the relative actuating cylinders of each pair (9*b*–9*c* and 10*b*–10*c*) are hydraulically connected in parallel. According to this embodiment each pair of horizontal arms may be individually commanded to extend or to retract by the operator.

Also the positioning of the suspension carriage 7, i.e. of the point of application of the lifting pull along the longitudinal axis of the balance 1 is controlled by an hydraulic cylinder 11 which is also controlled by the crane operator.

Of course the actuating means of the extensible horizontal arms and of the suspension carriage may also be electrical and/or pneumatical means. The choice of the type of actuator may be dictated by the type of lifting machine available. In case of hydraulically actuated mobile cranes, the choice of hydraulic actuators of the balance of the apparatus of the invention is generally preferable because it is possible to exploit the same hydraulic control station of the mobile crane for the balance actuators by simply arranging the necessary hydraulic connections from and to the hydraulic control station of the mobile crane to the actuating cylinders of the balance, through suitable control means which may be arranged on the same control panel of the crane. These hydraulic connections are not shown in the figures because they may be easily laid out by a skilled technician without the need for a detailed description.

As it may be observed in FIG. 2, a rigid vertical leg (respectively indicated with 12, 13, 14 and 15) is fixedly connected at a 90° angle to the free extremity of each of the four, telescopically extensible, horizontal arms of the balance. The 90° joint between the extremity of a horizontal arm and of the relative vertical leg is subject to a remarkable flexural component of the weight of the load (as will be evident to the technician) and therefore the joint should be suitably strengthened by a tension plate 20 (or bar) which effectively opposes the force acting on the joint. Also the vertical legs 12, 13, 14 and 15 are telescopically adjustable in length by means of a blocking peg 16 cooperating with a series of level holes 17, uniformly distributed along the telescopically extensible lower portion of each vertical leg.

The lowermost portion of each vertical leg is provided with a sturdy cantilevered foot 18 having a section which may be extended toward the interior of the "slinging" fork structure constituted by each pair of arms and this section may be more or less extended by telescopically adjustable means (16*p* and 17*p*) similar to the one used for adjusting the length of the vertical legs. The feet 18 are provided with a support plate 19, preferably swivelling and covered with a cushion of rubber or other impact absorbing material. The swivelling plates 19 may utilize a ball-and-dome joint of any known type commonly employed in boat cradles, as shown in the sectioned particular of FIG. 2*a*. Alternatively, instead of swivelling plates 19, substantially fixed or orientable plates covered with a cushioning pad of sufficient thickness of a readily compressible, resilient material, having appropriate compressive characteristics such as for example a rubber pad, may be used. Fixed plates may be pre-oriented in function of the type of keel of the boats to be handled and the compressible rubber pad ensures a sufficient degree of conformability of the support plates to the keel profile.

The hoisting apparatus of the invention operates as follows.

After having preset eventually the length of the vertical legs (i.e. of the two pairs of vertical legs 12–14 and 13–15, respectively, of FIG. 2) and the relative length of the feet 18 of the two pairs of vertical legs in function of the type of keel of the boat or boats to be handled, the operator commands the opening of the two pairs of telescopically extensible horizontal arms as much as adequate to the particular type of boat.

After having moved the balance above the boat and having lowered the structure on the boat for as much as necessary, the operator commands the retraction of one and of the other of the two pairs of telescopic horizontal arms until each pair of the relative vertical legs close against the shipboards of the boat to be lifted (either out of the water or of its cradle).

At this point, the operator commands the lifting of the boat by as much as sufficient to assess the longitudinal trim of the suspended load and in case the boat is not longitudinally balanced, the operator commands the movement, either by increments or in a continuous mode, in a direction or in the opposite direction, of the suspension carriage along the central longitudinal beam of the balance in order to correct an eventually observed unbalance. Through these maneuvers the operator is perfectly capable of applying the lifting pull in substantial coincidence with the axis of the center of gravity of the suspended load without the help of other personnel for taking care of the slinging and without leaving the control panel of the lifting crane.

When the haulage is completed, the operator commands the opening (extension) of the horizontal arms of the balance and moves the balance off the boat.

The control system for shifting the suspension carriage may be provided with an automatic device for returning the carriage to a neutral position (aligned with the center of gravity of the balance) which may be acted upon by the operator after having revised the load in order to return the carriage to a rest position for balancing the hoisting apparatus and be able to move it about in a perfect trim.

According to a particularly preferred embodiment of the hoisting apparatus of the invention, the balance 1 is provided with operator controlled means capable of rotating the load suspended on the hook in respect to the structure of the lifting crane about the axis of the lifting hook. This device further improves the operator maneuvers capabilities of the suspended load and is particularly useful for quay haulage using a mobile crane which may conveniently remain practically stationary. The operator is in fact capable of rotating the balance in order to align it above the boat or the suspended boat in order to align it to the quay or in respect to the cradle before resting it on the water or on the cradle. An embodiment of such a device for controlling the rotation of the load suspended on the crane's hook is schematically depicted in FIG. 3.

In the plan view of the detail depicted in FIG. 3, the profile of the terminal portion of the arm of a service crane, on the hook of which is suspended the hoisting structure of the invention/is indicated with 28. The suspension carriage 7, formed by a vertical steel plate on which are rotably mounted the four pairs of suspension wheels 8 for sliding the carriage along the pair of parallel longitudinal sections 2*a* and 2*b*, is visible in the detail. The supporting cantilever 21 is fixedly connected to the plate 7 of the hanging carriage and an hydraulic control station comprising a low voltage electric motor 26 and an oil pump 27 is mounted thereon. The hydraulic control station drives a cylinder 23 which is pivotally connected to the cantilever 21 at 24 and slidably hinged at 25 on a lever arm 22 which is mechanically connected to the structure of the crane's arm 28. By commanding the action of the electric motor in a direction or in a reverse direction, the operator is capable of rotating the load suspended on the rotable hook of the crane by the extension or the retraction of the hydraulic cylinder 23.

Of course, though the rotation mechanism of the load shown is in the form of a hydraulic cylinder acting upon two substantially parallel arms, the skilled technician will easily recognize that the spatial arrangement of these arms may be different, thus obtaining wider usable ranges of rotation, as well as that the transmission of a rotational motion may be implemented with different means.

We claim:

1. An apparatus for hoisting boats comprising a balance constituted by a steel frame having at least a central longitudinal beam provided with suspension means for rotatably hanging on a hook of a crane and at least two parallel crossbeams fixedly attached to the two extremities, respectively, of said central longitudinal beam, wherein each of said crossbeams is formed by a tubular central member fixedly connected to an extremity of said central longitudinal beam and by two horizontal arms, each horizontal arm being telescopically extensible out of one extremity of said tubular central member and said two arms being extensible and retractable by means of a remotely controlled actuator;

a rigid vertical leg, the length of which may be telescopically adjusted, is fixedly connected to the outermost extremity of each of said telescopically extensible horizontal arms of the balance and is provided with a cantilever foot which is also adjustable in length and which carries at an extremity thereof a support plate for the keel of a boat to be hoisted;

said suspension means for hanging on the hook of a crane essentially comprise a suspension carriage which can be moved along said central longitudinal beam by means of remotely controlled actuating means for changing the point of application of the hoisting pull along the longitudinal axis of the suspended load;

the balance, with said horizontal arms extended, being lowered on a boat to be hoisted until bringing the level of said feet below the level of the keel of the boat, said horizontal arms being retracted to bring said feet under the keel and said suspension carriage being positioned in coincidence with the center of gravity of the suspended load for hoisting the boat resting on said support plates in a substantially horizontal trim.

2. The hoisting apparatus according to claim 1, wherein said actuators are hydraulic cylinders.

3. The hoisting apparatus according to claim 2, wherein the horizontal arms of each of said two crossbeams of the balance are simultaneously driven by means of two pairs of hydraulic cylinders and the cylinders of both pairs are driven in common by means of a single control.

4. The hoisting apparatus according to claim 1, wherein said vertical legs are telescopically extensible and the length thereof is manually adjusted by means of a blocking peg and a series of level holes present on a lower portion of the legs which is telescopically extensible out of the extremity of a substantially tubular top portion of the vertical legs.

5. The hoisting apparatus according to claim 1, wherein the length of said cantilevered feet is manually adjustable.

6. The hoisting apparatus according to claim 1, further comprising remotely controlled means for rotating the load suspended to the crane's hook in respect to the crane.

7. The hoisting apparatus according to claim 6, wherein said means for rotating comprise a hydraulic cylinder rotatably hinged on an arm fixedly connected to said suspension carriage and slidably engaged with an arm fixedly connected to the crane.

* * * * *